United States Patent [19]

Goettl et al.

[11] 3,967,322

[45] July 6, 1976

[54] FLUID CONTAINING STRUCTURE

[75] Inventors: Adam D. Goettl; Bruce A. Goettl, both of Phoenix, Ariz.

[73] Assignee: Amoy Research and Development Co., Phoenix, Ariz.

[22] Filed: June 3, 1974

[21] Appl. No.: 475,823

Related U.S. Application Data

[62] Division of Ser. No. 363,345, May 24, 1973, Pat. No. 3,833,944.

[52] U.S. Cl. ..... 4/172; 52/169 R; 277/166

[51] Int. Cl.[2] ..... E04H 3/16

[58] Field of Search ..... 4/172, 172.19, DIG. 9, 4/146, 160, 173, 177, 208, 252 R; 210/169; 119/5; 277/166, 188, 189, 116.2; 52/169, 248, 393, 403; 220/18, 1 B

[56] References Cited

UNITED STATES PATENTS

| | | | |
|---|---|---|---|
| 2,035,764 | 3/1936 | Rowell | 52/248 X |
| 2,842,073 | 7/1958 | Huston et al. | 52/393 X |
| 2,993,212 | 7/1961 | Ruhm | 4/146 |
| 3,148,379 | 9/1964 | Muller | 4/252 |
| 3,229,581 | 1/1966 | Walter | 52/393 X |
| 3,271,916 | 9/1966 | Omholt | 52/393 |
| 3,286,577 | 11/1966 | Weidner | 277/166 X |
| 3,288,222 | 11/1966 | Urbanowsky | 277/116.2 X |
| 3,439,362 | 4/1969 | Goettl | 4/172 |
| 3,588,924 | 6/1971 | Goettl | 4/172.19 |
| 3,641,595 | 2/1972 | Viessmann | 4/172.19 |
| 3,710,401 | 1/1973 | Goettl | 4/172.19 |

*Primary Examiner*—Richard E. Aegerter
*Assistant Examiner*—Stuart S. Levy
*Attorney, Agent, or Firm*—Herbert E. Haynes, Jr.

[57] ABSTRACT

A fluid containing structure including a horizontally disposed base member with means formed therein for positionally engaging the lower end of an upstanding endless wall. Seal and support means provided at the juncture of the lower end of the wall with the base member seals that juncture and structurally supports the wall.

3 Claims, 11 Drawing Figures

FLUID CONTAINING STRUCTURE

CROSS REFERENCE TO RELATED APPLICATION

This application is a divisional application of a copending U.S. patent application entitled FLUID CONTAINING STRUCTURE, Ser. No. 363,345, filed May 24, 1973, by the same inventors, now U.S. Pat. No. 3,833,944.

BACKGROUND OF THE INVENTION

1. Field of the Invention

This invention relates to containers and more particularly to low cost easily assembled fluid containing structures which may be erected as a permanent installation or may be easily dismantled.

2. Description of the Prior Art

It is oftentimes desirable to erect a low cost substantially maintenance free fluid container which can be dismantled if desired or can be left as a permanent structure. For example, above ground swimming pools are usually dismantled at the end of the season to eliminate costly off-season maintenance and to allow the space usually occupied by the pool to be used for other purposes. However, in some climates and in some particular installations it is more desirable to leave the structure assembled.

A particular prior art structure commonly used as an above ground swimming pool, employs a suitably braced endless upstanding wall erected on a pre-prepared ground surface. A plastic liner is assembled within the wall for containing the water. While this type of structure does provide means for easy assembly and disassembly, it has several disadvantages. The plastic liner is particularly subject to leakage resulting from weeds growing up through the bottom of the liner and from tears, punctures, and the like resulting from the normal activity of swimmers. Off-season damage to the liners resulting from improper storage often necessitates replacement of the liners. Cold weather causes the plastic material to become stiff and brittle and the danger of tearing the liners at this time is particularly acute. It has been estimated that the average life of a liner of this type is two or three seasons.

In an attempt to devise a fluid containing structure not requiring the use of a plastic liner, several methods have been tried with varying degrees of success. In general, a base structure, normally of concrete and having an endless upwardly facing trough formed therein, is employed and an endless wall is erected in an upstanding position within the trough. Sealing of the annular junction between the lower end of the upstanding wall and the base structure is generally accomplished in one of two ways. First, is to employ a curable caulking compound. If the compound used for this type of a seal sets up as a solid non-resilient substance, wall vibrations due to fluid movement and normal laterally directed forces will cause cracking and ultimate deterioration of the compound. If the compound employed cures as a resilient material, dislodging often results from wall vibrations. The second type of seal commonly employed in this type of above ground fluid container is a resilient gasket which has much the same problems as the above described curable resilient caulking compound.

The problems associated with the previously described caulking compounds and resilient gasket have produced elaborate and expensive wall supporting structures in attempts to minimize the effects of wall movement.

It would therefore be desirable to provide a new and novel, low cost fluid containing structure which overcomes some of the drawbacks of the prior art.

SUMMARY OF THE INVENTION

In accordance with the invention disclosed, a new and useful low cost, reliable fluid containing structure is provided which is particularly well adapted for use as an above ground swimming pool.

The fluid containing structure of the present invention is disclosed in two embodiments, the first being particularly well suited for use in installations intended for periodic dismantling. The second embodiment is best suited for installations of a more or less permanent nature.

The first embodiment of the present invention employs a resilient gasket to seal the joint between the wall and the base. The gasket engages both the lower end of the wall and the base structure and is compressed into sealing and wall supporting engagement by a compression exerting bond means. The compression exerting bond means cooperates with a specific type of base structure to fixidly locate the gasket so that it cannot be dislodged, and also provides structural support for the wall.

The second embodiment of the present invention employs a caulking compound which cures into a resilient substance in combination with a simplified wall supporting structure which prevents wall vibrations or movements from dislodging the compound.

Accordingly, it is an object of the present invention to provide a new and useful low cost fluid containing structure.

Another object of the present invention is to provide a new and useful fluid containing structure which is easy to erect and may be easily dismantled.

Another object of the present invention is to provide a new and useful fluid containing structure which employs a special type of base structure which cooperates with a resilient gasket and compression exerting bond means to seal and structurally support an upstanding endless wall erected on said base structure.

Another object of the present invention is to provide a new and useful fluid containing structure which employs a base structure of a special construction which cooperates with a curable resilient caulking compound and a simplified wall supporting structure to seal and structurally support an upstanding endless wall erected on said base structure.

The foregoing and other objects of the present invention, the various features thereof, as well as the invention itself, may be more fully understood from the following description when read in conjunction with the accompanying drawings.

DESCRIPTION OF THE PREFERRED EMBODIMENTS

Figure 1:
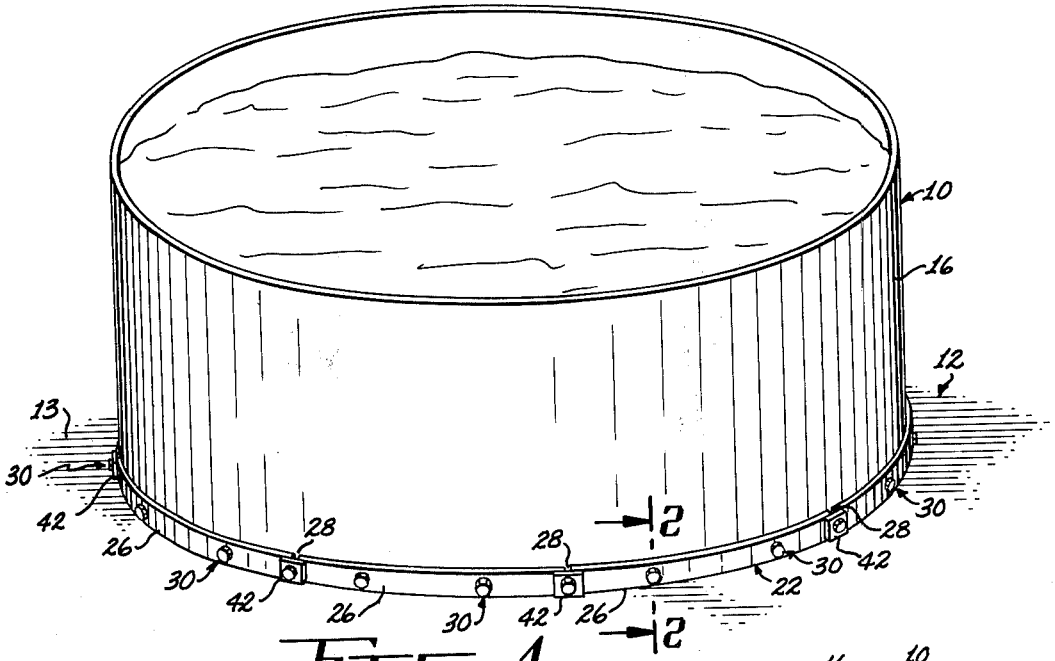
FIG. 1 is a perspective view of the fluid containing structure of the present invention incorporating the various features thereof.

Referring more particularly to the drawings, FIG. 1 illustrates a fluid containing structure 10 ideally suited for use as an above ground swimming pool or fluid storage tank.

The tank 10 includes a horizontally disposed base 12 which may be fabricated of cement, metal or any other suitable material. In the embodiments illustrated in FIGS. 1–5, the base 12 is formed with a substantially flat apron 13 circumscribing a raised platform 14 which serves as the bottom of the pool or tank 10. A vertically disposed endless surface 15 forms the periphery of the platform and interconnects the apron 13 with the raised platform 14.

The surface 15 of the platform 14 serves as a structural support for an endless upstanding wall 16 and against which the wall is sealed to form the base 12 and the wall 16 into a fluid tight structure as will hereinafter be described in detail.

The upstanding endless wall 16 may be formed of metal or any other suitable material and is positioned on the base 12 so that its lower end 18 is adjacent to and circumscribes the endless peripheral surface 15 of the platform 14.

A compressible resilient gasket 20 such as of rubber, Neoprene, or the like, is interposed between the surface 15 and the lower end 18 of the wall 16. The gasket 20 may be formed of a plurality of segments or a single elongated strip as desired.

Compression exerting bond means 22 is positioned in contiguous encircling engagement with the outwardly facing surface 24 of the lower end 18 of the wall 16. The compression exerting bond means is capable of being circumferentially reduced in size to exert an evenly distributed circumferential compressive force on the lower end 18 of the wall 16 and on the gasket 20. This force will seal the junction between the surface 15 and the wall 16 and structurally support the wall as will be described in detail.

Figure 5:
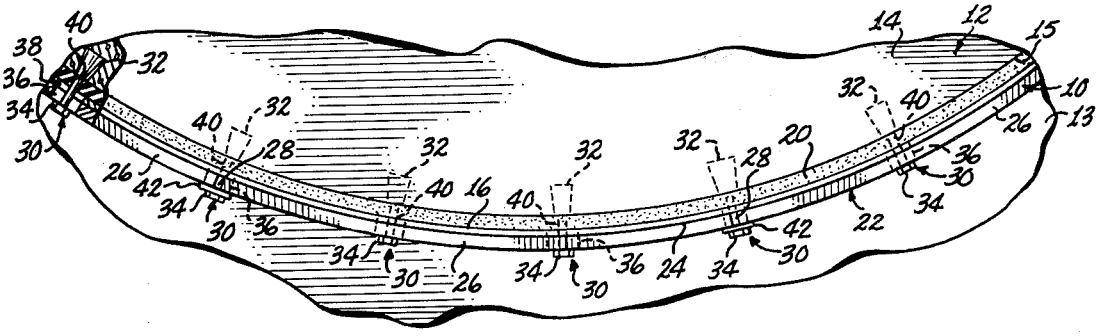
FIG. 5 is a fragmentary plan view of the embodiments shown in FIGS. 2, 3, and 4.

The compression exerting bond means 22 of this embodiment includes a plurality of arcuately shaped draw band segments 26 the number of which is determined by the diameter of the tank 10 being erected. The length of each segment 26 is selected so that a gap 28 is provided between each of the adjacent segments as shown in FIG. 5. The gaps 28 are provided so that the circumference of the compression exerting bond means 22 may be reduced to apply the circumferentially compressive force as hereinbefore described.

The bond means 22, wall 16, and the gasket 20 are mounted to the surface 15 of the platform 14 by draw means 30 which not only mounts these elements but also provides means by which the diameter of the compression exerting bond means 22 is reduced to apply the above described circumferentially compressive force.

The draw means 30 includes a plurality of nuts 32, or internally threaded sleeves, captively embedded within the surface 15 of the platform 14 and an equal number of bolts 34. As best seen in FIG. 5, the nuts 32 are radially disposed in spaced increments about the endless surface 15 and are flush with that surface. The nuts 32 are preferably formed with an enlarged bottom 35, or inwardly disposed end, which prevents the nuts from being pulled out of the surface 15.

Figure 2:
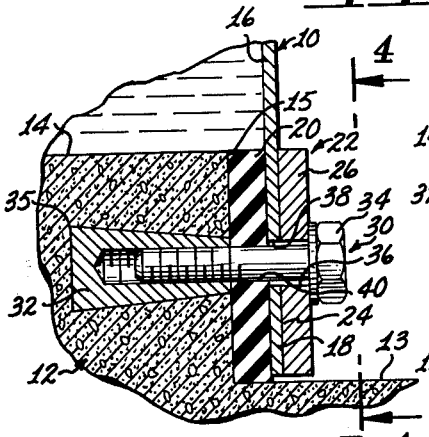
FIG. 2 is an enlarged sectional view taken on the line 2—2 of FIG. 1.

The embodiment shown in FIG. 2 shows the bolts 34 passing through horizontally elongated slots 36 formed in the draw band segments 26, similarly formed slots 38 provided in the lower end 18 of the wall, through apertures 40 formed in the gasket and they threadingly engage their respectively aligned nuts 32.

Figure 3:
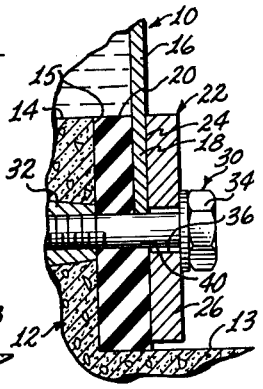
FIG. 3 is an enlarged sectional view similar to FIG. 2 and illustrating a modification thereof.
Figure 4:
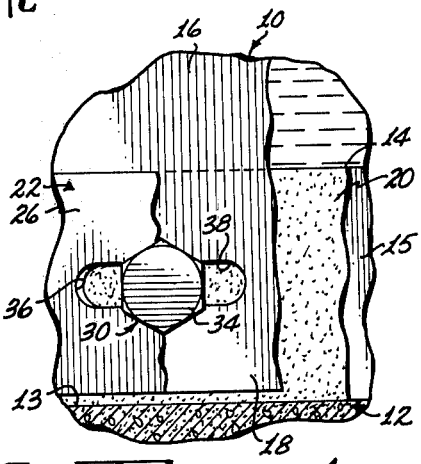
FIG. 4 is a sectional view taken on the line 4—4 of FIG. 2.

The embodiment shown in FIG. 3 illustrates the bolts 34 as passing through the slots 36 of the draw band segments 26, through the apertures 40 of the gasket 20 and into threaded engagement with their respectively aligned nuts. Thus, it may be seen that the wall 16 sits upon the bolts 34 rather than the bolts passing through slots formed therein. This arrangement eliminates the formation of slots and will facilitate assembly.

Retainer plates 42 may be provided at each of the gaps 28 between adjacent draw band segments 26 to prevent the bands from becoming disengaged from the specific draw means 30 located at the gaps 28.

It may now be seen that by applying the circumferentially compressive force as described above, lower end 18 of the endless wall 16 will be tightly held against the surface 15, thus, the wall 16 is provided with sufficient structural strength to enable it to withstand the forces applied thereto by the fluid contained within the tank 10. It may also be seen that the gasket 20 will be compressed to form a fluid tight seal between the surface 15 and the wall 16 and the gasket will not be subject to dislodgement by virtue of the compression force and the bolts 34 which pass therethrough.

While the above described structural details of the draw means 30 constitutes the preferred form of that structure, it should be noted that the same results could be achieved by captively embedding studs (not shown) and employing suitable nuts for threading engagement therewith.

Figure 6:
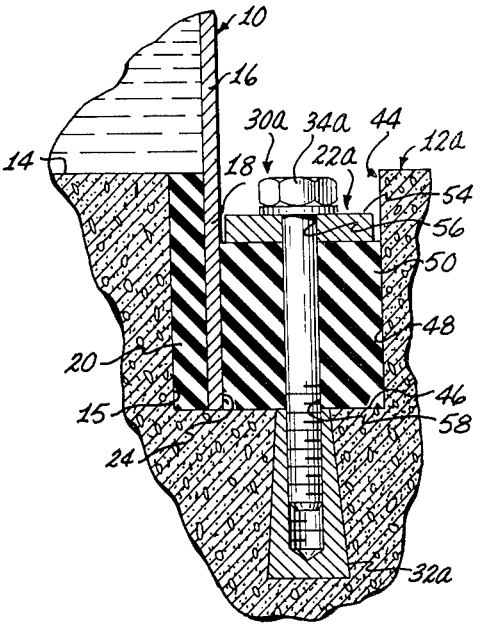
FIG. 6 is a sectional view similar to FIG. 2 and illustrating a modification thereof.
Figure 7:
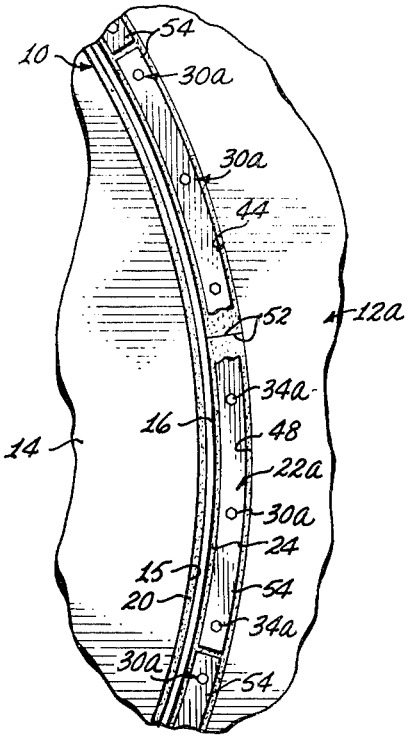
FIG. 7 is a fragmentary plan view illustrating the various features of the modification shown in FIG. 6.

Reference is now made to FIGS. 6 and 7 wherein a modified form of the previously described embodiment of the present invention is illustrated. In this modification, the base 12*a* is of a different configuration in that the surface 15 of the platform 14 forms part of a trough 44 which circumscribes the platform 14 as opposed to the flat apron 13 of the previous embodiment. A bottom surface 46 and an outwardly disposed vertical surface 48 cooperate with the surface 15 to form the trough 44 into an endless upwardly facing structure having a U-shaped cross sectional configuration.

The gasket 20, as before, is interposed between the surface 15 and the lower end 18 of the wall 16.

Compression exerting bond means 22a of this modification includes a resilient compressible body 50, such as of rubber or the like, nestibly positioned so as to be in contiguous encircling contact with the outer face 24 of the lower end 18 of the wall 16, and also in contiguous contact with the bottom surface 46 and outer surface 48 of the trough. The compressible body 50 may be formed of an elongated strip of material having the opposite ends 52 thereof placed in abutting relationship as shown in FIG. 7, or if desired, may be made up of a plurality of shorter pieces (not shown). The compression exerting bond means 22a also includes a plurality of plates 54, each being of arcuate shape as shown in FIG. 7. The plates 54 are positioned in an end to end relationship within the trough 44 atop the compressible body 50.

Draw means 30*a*, of this modification, includes a plurality of nuts 32*a* (one shown) captively embedded within the bottom surface 46 of the trough 44, and an equal number of bolts 34*a*. As seen in FIG. 7, the draw means 30*a* are radially disposed in spaced increments about the platform 14 and are located within the trough 44 flush with the bottom surface 46 thereof.

The bolts 34*a* pass downwardly through apertures 56 formed in the plates 54 and through similar apertures 58 provided in the compressible body 50 and are threadingly engageable with their respectively aligned nuts.

It may now be appreciated that tightening of the bolts 34*a* will pull the plates 54 downwardly and exert a compression force on the body 50. This force will result in the body 50 applying a circumferentially compressive force on the surface 24 of the wall 16 causing it to compress the gasket 20, and also provide the necessary structural stability for the wall in essentially the same manner previously described.

Reference is now made to FIGS. 8–11 wherein further embodiments of the present invention are illustrated. In these embodiments a base 12*b* is employed which is similar to the previously described base 12*a* in that the endless upwardly facing trough 44 is formed therein. The upstanding wall 16 is positioned within the trough 44 so that its lower end 18 is in contiguous engagement with the outer vertical surface 48 of the trough.

A curable caulking compound 60 is placed within the trough 44 so as to be in sealing engagement with the inner vertical surface 15, the bottom surface 46 and with the inwardly facing surface 62 of the lower end 18 of the upstanding wall 16.

The caulking compound 60 may be any of the well known substances which, upon curing, forms a resilient mass which is capable of absorbing forces applied thereto resulting from movements or vibrations of the upstanding wall.

The caulking compound 60 by its very nature acts as a seal only, that is, it provides relatively little structural support for the upstanding wall 16. Therefore, a means for supporting the wall 16 is needed.

Figure 8:
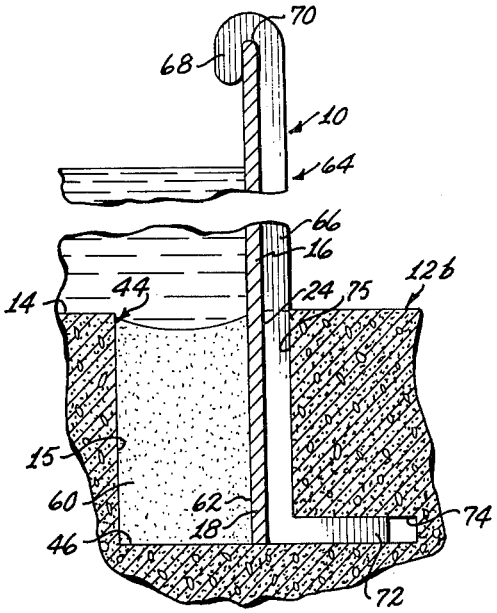
FIG. 8 is a fragmentary sectional view similar to FIG. 2 and illustrating a second embodiment of the present invention.
Figure 9:
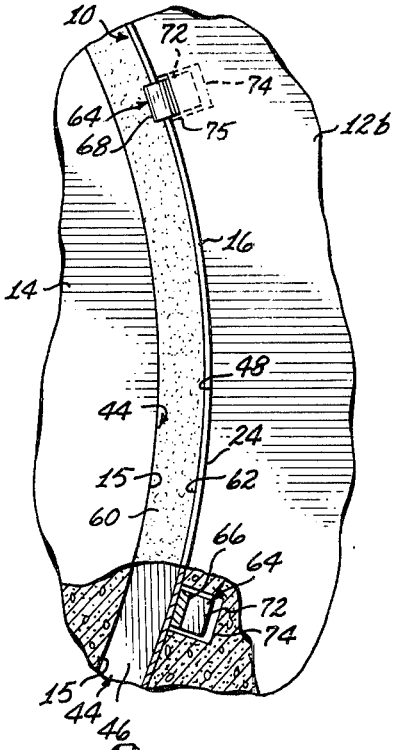
FIG. 9 is a fragmentary plan view of the embodiment shown in FIG. 8.

Wall supporting or tie-down means 64, FIGS. 8 and 9, are provided to supply the necessary wall support as previously described. As shown in FIG. 9 one of the tie-down means 64 is provided at each of a plurality of radially disposed spaced apart locations about the periphery of the upstanding wall 16. Each of the tie-down means 64 is connected to the wall 16 and is anchored within the trough 44 to prevent upward movement of the wall as will be described.

The tie-down means 64 illustrated in FIG. 8 is typical and is shown to include an elongated upstanding strap 66 which is positioned in contiguous contact with the external surface of the wall and is transverse to the circumference thereof. An inwardly facing hook 68 is formed on the upper end of the strap 66 for engaging the upper end 70 of the wall 16. An outwardly extending anchor lug 72 is formed on the lower end of the strap 66 for anchoring the tie-down means 64 within the trough 44.

The lugs 72 of the tie-down means 64 are positioned within radial notches 74 formed to extend outwardly from the bottom surface 46 of the trough. The straps 66 extend upwardly from their respective lugs 72 and may be positioned within notches 75 formed in the outer surface 48 of the trough 44, otherwise the wall 16 may be allowed to deflect inwardly around each of the tie-down means.

Figure 10:
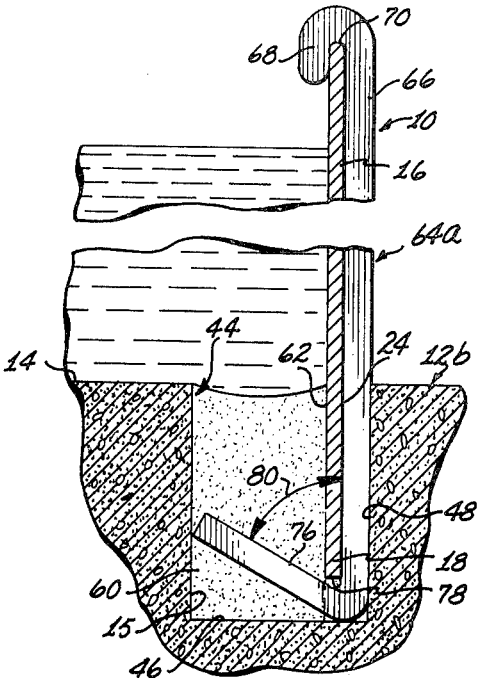
FIG. 10 is a sectional view similar to FIG. 8 and illustrating a modification of that embodiment.
Figure 11:
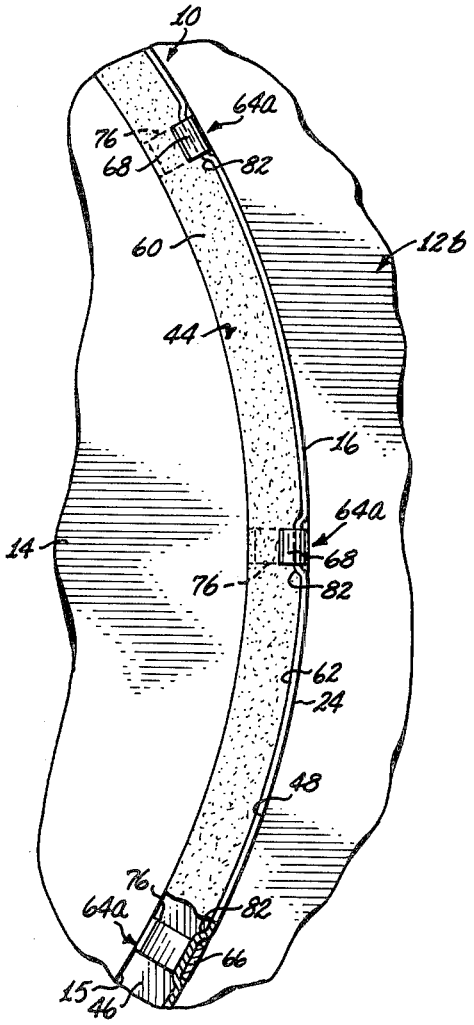
FIG. 11 is a fragmentary plan view of the modification shown in FIG. 10.

An alternate form of tie-down means 64*a* is illustrated in FIGS. 10 and 11 and is seen to have its anchor lug 76 extending inwardly into the trough through a slot 78 formed in the upstanding wall 16. It should be noted that the anchor lug 76 may pass under the wall 16 instead of through the slot 28. The lug 76 is formed by bending the end of the strap 66 back upon itself so that the lug 76 is disposed at an acute angle 80 with respect to the longitudinal dimension of the strap 66. The length of the lug 76 is selected to be longer than the width of the trough 44 to provide an interference fit therebetween. Thus, the angular disposition of the lug 76 plus the interference fit allows the lower end of the tie-down means 64*a* to be easily inserted into the trough and will create a bind when upward movement is attempted.

As seen in FIG. 11 the straps 66 of each tie-down means 64a are interposed between the periphery of the wall 16 and outer surface 48 of the trough 44. This arrangement may include inwardly directed off-sets 82 provided in the wall 16 at the locations of each of the tie-down means 64*a*. It should be noted that the previously described notches 75 would accomplish the same purpose or the wall may simply be allowed to deform inwardly as previously described.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. A fluid containing structure comprising:

a. a base having a platform circumscribed by a vertically depending periphery which forms the inner vertical surface of an endless upwardly facing U-shaped in cross section trough, said trough having an endless bottom extending outwardly from the lower end of the periphery of the platform and having an endless outer vertical surface extending upwardly from the outermost end of the bottom of said trough;

b. an endless upstanding wall having the lower end thereof encircling the periphery of the platform of said base in juxtaposed relationship thereto;

c. a resilient compressible gasket interposed between the periphery of the platform of said base and the lower end of said upstanding wall;

d. compression exerting band means encircling the lower end of said upstanding wall in said trough for applying a circumferentially compressive force thereto, said compression exerting band means comprising;

a resilient compressible body positioned within said trough and held thereby in contiguous engagement with the outwardly facing surface of the lower end of said upstanding wall, and at least a pair of arcuately shaped elongated plates placed in end to end relationship with each other atop the upwardly facing surface of said resilient compressible body; and e. draw means mounted at radially disposed spaced increments about the periphery of the platform of said base and engaging said compression exerting band means for causing said compression exerting band means to apply the circumferentially compressive force.

2. A fluid containing structure as claimed in claim 1 wherein said draw means comprises:

a. a plurality of nuts positioned in spaced increments along the length of the bottom of said trough, each of said nuts captively embedded within the bottom surface of said trough and flush therewith; and b. a bolt for each of said nuts, each of said bolts passing through said compression exerting bond means and into threaded engagement with an aligned one of said nuts.

3. A fluid containing structure comprising:

a. a base having an endless upwardly facing U-shaped in cross-section trough formed therein, the trough having spaced apart inner and outer vertical surfaces connected at their lower ends with a bottom surface;

b. an endless upstanding wall having the lower end thereof positioned within the trough of said base and in juxtaposed relationship with the inner vertical surface of the trough;

c. a resilient compressible gasket interposed between the inner vertical surface of the trough of said base and the lower end of said upstanding wall;

d. a resilient compressible body within the trough of said base in contiguous contact with the outwardly facing surface of the lower end of said upstanding wall, and in contiguous contact with the bottom and outer vertical surfaces of the trough of said base;

e. at least a pair of elongated arcuately shaped plates atop the upwardly facing surface of said compressible body, said plates placed in an end to end relationship with each other;

f. a plurality of nuts provided in spaced increments along the bottom surface of the trough of said base and captively embedded therein; and g. a bolt for each of said nuts, each of said bolts passing downwardly through said arcuate plates, downwardly through said resilient compressible body and into threaded engagement with an aligned one of said nuts.

* * * * *